US006452141B1

(12) United States Patent
Shon

(10) Patent No.: US 6,452,141 B1
(45) Date of Patent: Sep. 17, 2002

(54) MICROWAVE OVEN WITH MAGNETIC FIELD DETECTING DEVICE

(75) Inventor: Jong-Chull Shon, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/963,367

(22) Filed: Sep. 27, 2001

(30) Foreign Application Priority Data

Jun. 30, 2001 (KR) ..... 2001-38697
Aug. 20, 2001 (KR) ..... 2001-50022

(51) Int. Cl.[7] ..... H05B 6/68
(52) U.S. Cl. ..... 219/709; 219/704; 219/746; 324/95; 333/109
(58) Field of Search ..... 219/709, 704, 219/705, 746, 750; 324/95; 333/109

(56) References Cited

U.S. PATENT DOCUMENTS 3,670,134 A * 6/1972 Bucksbaum ..... 219/704
4,211,911 A * 7/1980 Dehn ..... 324/95
5,237,141 A * 8/1993 Yoshino et al. ..... 219/709
6,166,364 A * 12/2000 Ha ..... 219/709

FOREIGN PATENT DOCUMENTS

EP 1 021 069 A2 7/2000
JP 2-275222 * 11/1990 ..... 219/709

* cited by examiner

*Primary Examiner*—Philip H. Leung
(74) *Attorney, Agent, or Firm*—Robert E. Bushnell, Esq.

(57) ABSTRACT

Disclosed herein is a microwave oven with a magnetic field detecting device. The microwave oven includes a magnetron for generating microwaves and a wave guide for guiding the microwaves to a cooking chamber. A detection opening is formed in one side of the wave guide to allow a magnetic field generated by standing waves formed in the wave guide to be discharged from the wave guide. The magnetic field detecting device is formed on a board mounted on the wave guide to detect the magnetic field discharged through the detection opening.

8 Claims, 11 Drawing Sheets

MICROWAVE OVEN WITH MAGNETIC FIELD DETECTING DEVICE

CLAIM OF PRIORITY

This application makes reference to, incorporates the same herein, and claims all benefits s accruing under 35 U.S.C. §119 from my application entitled MICRO WAVE OVEN INCLUDING MAGNETIC FIELD DETECTOR filed with the Korean Industrial Property Office on Jun. 30, 2001 and there duly assigned Ser. No. 2001-38697 and my application entitled MICRO WAVE OVEN INCLUDING MAGNETIC FIELD DETECTOR filed with the Korean Industrial Property Office on Aug. 20, 2001 and there duly assigned Ser. No. 2001-50022.

BACKGROUND OF THE INVENTION

1. Field of the Invention

The present invention relates generally to a microwave oven provided with a magnetic field detecting device for detecting standing waves.

2. Description of the Prior Art

As well known to those skilled in the art, a microwave oven is an appliance for cooking foods. The intensity of microwaves generated by the magnetron of the microwave oven is determined according to the characteristics of food to be cooked. That is, the characteristics of foot to be cooked, such as the material and shape of food, affect the absorption of microwaves and the amount of absorbed energy, so the microwave oven carries out correct cooking after learning the characteristics of foot to be cooked using a variety of sensors.

The microwaves are formed of a combined electric field and magnetic field, and are radiated from a magnetron through a wave guide to a cooking chamber. In the wave guide, a standing wave is generated by microwaves radiated from the magnetron to the cooking chamber, and microwaves reflected from the cooking chamber to the wave guide.

FIG. 1 is a diagram showing magnetic field detection by the microwave oven. As illustrated in FIG. 1, a conventional electromagnetic field detecting device of a microwave oven for detecting standing waves 30 is formed by grounding one end of an antenna sensor 20 onto the inner surface of the wall of a wave guide 10 through the hole 11 formed in the wall of the wave guide by means of a welding process.

In order to form a predetermined size of a detecting cross section between the wave guide 10 and the antenna sensor 20, the antenna sensor 20 forms a hook shape at its one end. The standing waves 30 are detected by detecting an electromagnetic field, which is generated by the standing waves reflected into the interior of the wave guide 10 and passed through the detection cross section.

As described above, the conventional detecting device of the microwave oven is grounded by welding one end of the antenna sensor to the inner surface of the wall of the wave guide, and is connected to various circuit elements by extending the other end of the antenna sensor out of the wave guide. As a result, there should be carried out processes in which the antenna sensor is welded to the wall of the wave guide and is connected to various circuit elements, so the number of processes is increased and the procedure becomes complicated, thereby hindering the automation of manufacturing and mass production of the microwave oven. Accordingly the productivity of the microwave oven is considerably reduced.

In addition, in the microwave oven with the conventional electromagnetic field detecting device, the position of the antenna sensor secured to the wave guide cannot be accurately controlled, so the cross section formed by the hook portion of the antenna sensor is not constant. As a result, the value of voltage is not accurately detected, so there occurs the problem that the reliability of the detected standing wave data is reduced.

SUMMARY OF THE INVENTION

Accordingly, the present invention has been made keeping in mind the above problems occurring in the prior art, and an object of the present invention is to provide a microwave oven with a magnetic field detecting device, which can be easily fabricated, reduce an error in its assembly, and ensure a certain detection area for detection of standing waves.

In order to accomplish the above object, the present invention provides a microwave oven having a magnetron for generating microwaves and a wave guide for guiding the microwaves to a cooking chamber, wherein a detection opening is formed in one side of the wave guide for allowing a magnetic field generated by standing waves formed in the wave guide to be discharged from the wave guide, comprising a magnetic field detecting device formed on a board mounted on the wave guide for detecting the magnetic field discharged through the detection opening.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DESCRIPTION OF THE PREFERRED EMBODIMENTS

Figure 1:
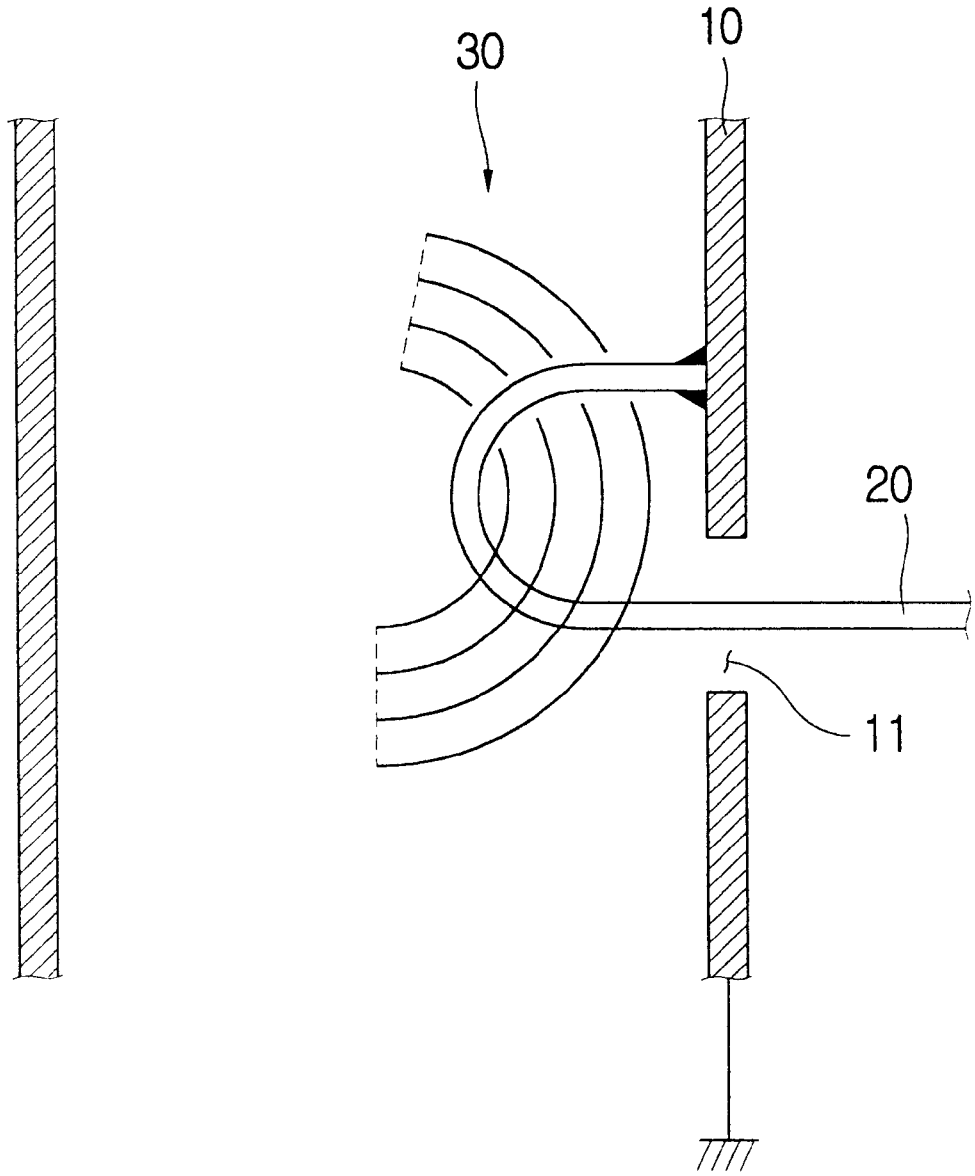
FIG. 1 (Prior Art)
FIG. 1 is a schematic diagram showing the detection of a magnetic field.

Reference now should be made to the drawings, in which the same reference numerals are used throughout the different drawings to designate the same or similar components.

Figure 2:
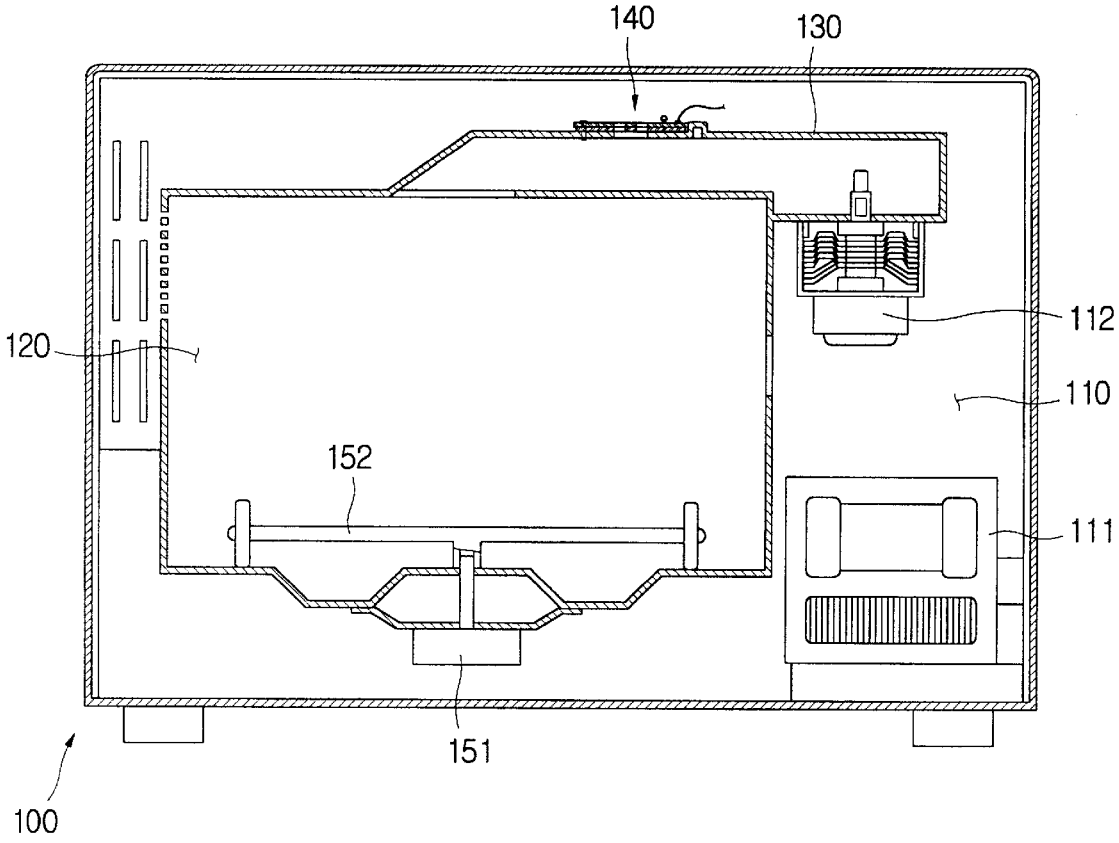
FIG. 2 is a cross section showing a microwave oven with a magnetic field detecting device in accordance with the present invention.

FIG. 2 is a cross section showing a microwave oven with a magnetic field detecting device in accordance with a first embodiment of the present invention.

Referring to FIG. 2, the microwave oven is comprised of a body 100. The oven body 100 includes an electrical component room 110 and a cooking chamber 120. A high-voltage transformer 111, a magnetron 112, etc. are placed in the electrical component room 110.

The oven body 100 further includes a wave guide 130 for transmitting standing waves generated by the magnetron 112 to the cooking chamber 120 and a magnetic field detecting device 140 mounted on one side of the wave guide 130 to detect standing waves.

A tray 152 is positioned in the cooking chamber 120 to hold food. A tray motor 151 including a rotation detecting unit (will be described later) is placed under the cooking chamber 120 to rotate the tray 152.

Figure 3A:
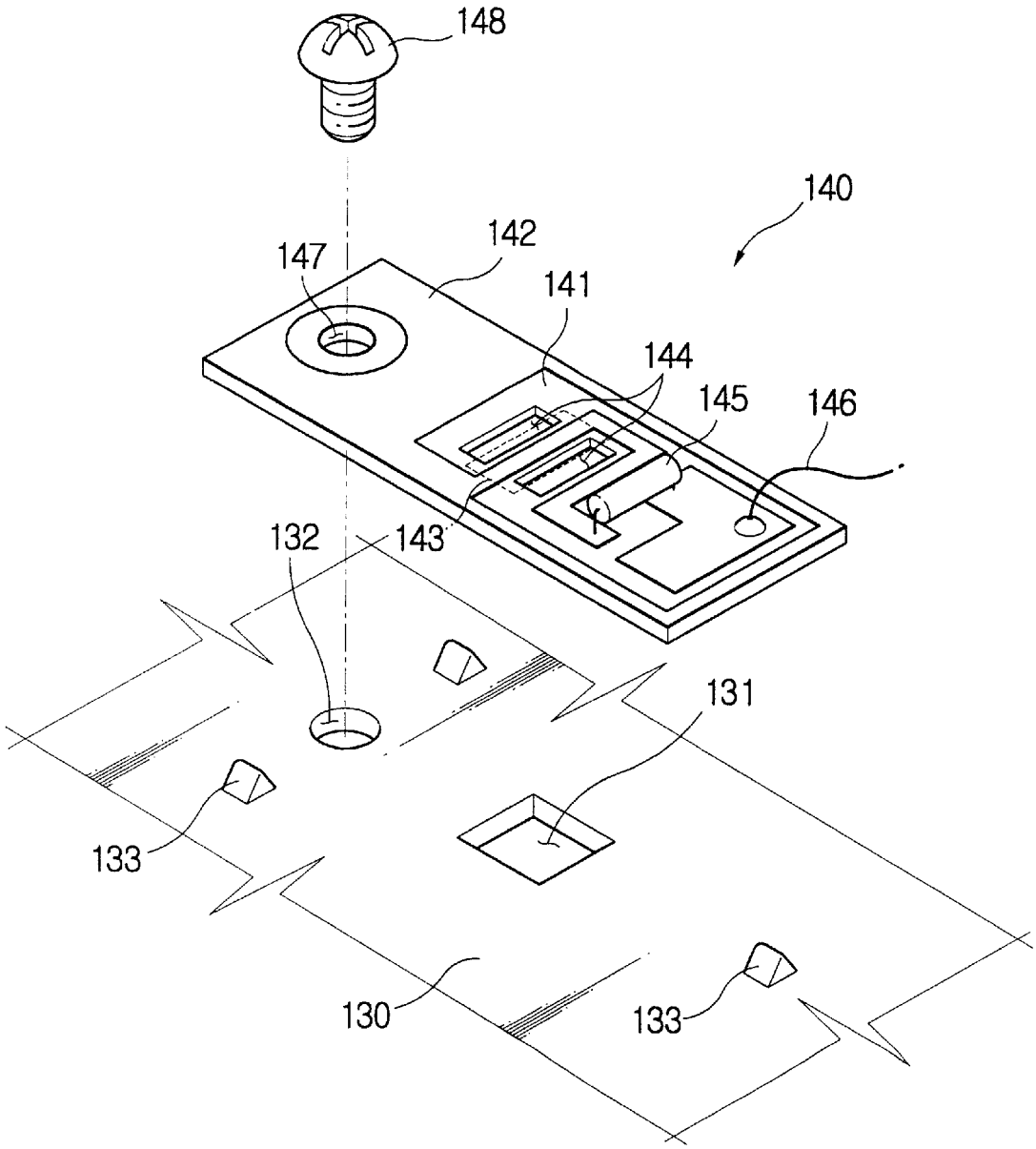
FIG. 3*a* is a perspective view showing a magnetic field detecting device in accordance with a first embodiment of the present invention.

FIG. 3*a* is a perspective view showing a magnetic field detecting device in accordance with a first embodiment of the present invention.

Referring to FIG. 3*a*, a securing hole 132 is formed in the wall of the wave guide 130 and a plurality of attachment projections 133 are formed on the wall of the wave guide 130 so as to secure the magnetic field detecting device 140. A detection opening 131 of a certain size is formed through the wall of the wave guide 130 so that the magnetic field of standing waves issues from the wave guide 130.

The magnetic field detecting device of the present invention is comprised of an antenna sensor 143 constructed by forming a magnetic, conductive printed circuit 142 on a non-magnetic board 141 to detect the magnetic field of standing waves discharged through the detection opening 131 and provided with a securing hole 147 to fasten a bolt 148 into the securing hole 132, a diode 145 for rectifying signals detected by the antenna sensor 143, and a lead wire 146 for discharging the signals rectified by the diode 145.

The antenna sensor 143 is formed to bisect the detection opening 131 when the magnetic detecting device 140 is mounted on the outer surface of the wave guide 130. Two detection holes 144 are provided beside the antenna sensor 143 so that a magnetic field having passed through the detection opening 131 is sufficiently interlinked with the antenna sensor 143, thereby eliminating the portions of the printed circuit.

Although the size of the detection opening 131 formed the wall of the wave guide 130 is varied according to the output of the magnetron, the diameter of the detection opening 131 may be about 5 mm to allow a voltage of 5 Volts to be induced to the antenna sensor 143.

Figure 3B:
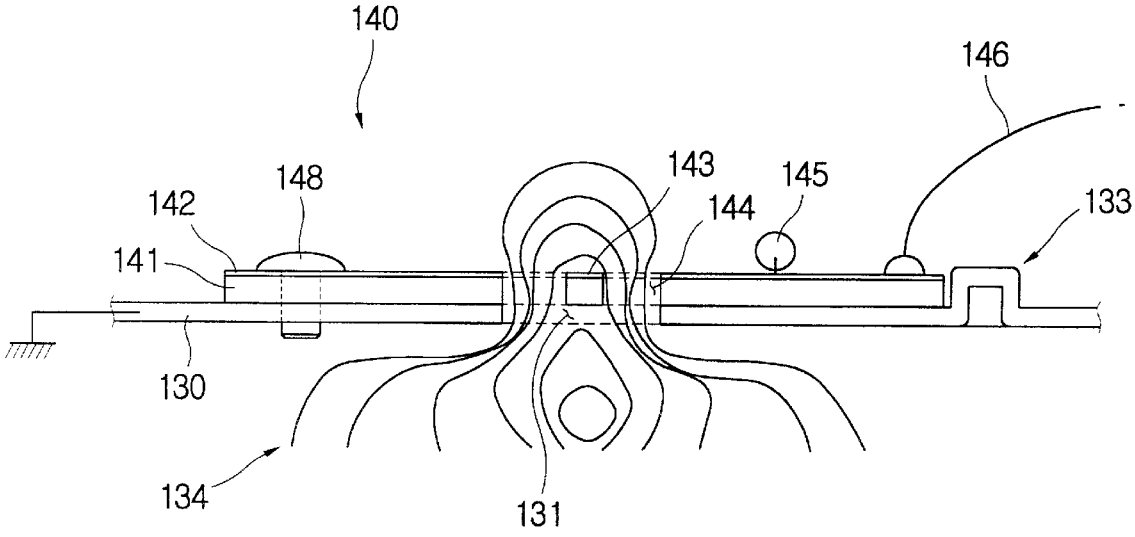
FIG. 3*b* is a diagram showing the detection of a magnetic field by the magnetic field detecting device of the first embodiment.

FIG. 3*b* is a diagram showing the detection of a magnetic field by the magnetic field detecting device of the first embodiment.

Referring to FIG. 3*b*, the magnetic field 134 generated by standing waves formed in the wave guide 130 is discharged from the wave guide 130 through the detection opening 131. In this case, the magnetic field 134 generated by the standing waves forms a closed loop through detection holes 144 provided beside the antenna sensor 143 of the magnetic field detecting device 140. Accordingly, detection signals, which are alternating signals, are induced to the antenna sensor 143 by the magnetic field 134. The detection signals are rectified by the diode 145 and output through the lead wire 146.

Figure 4A:
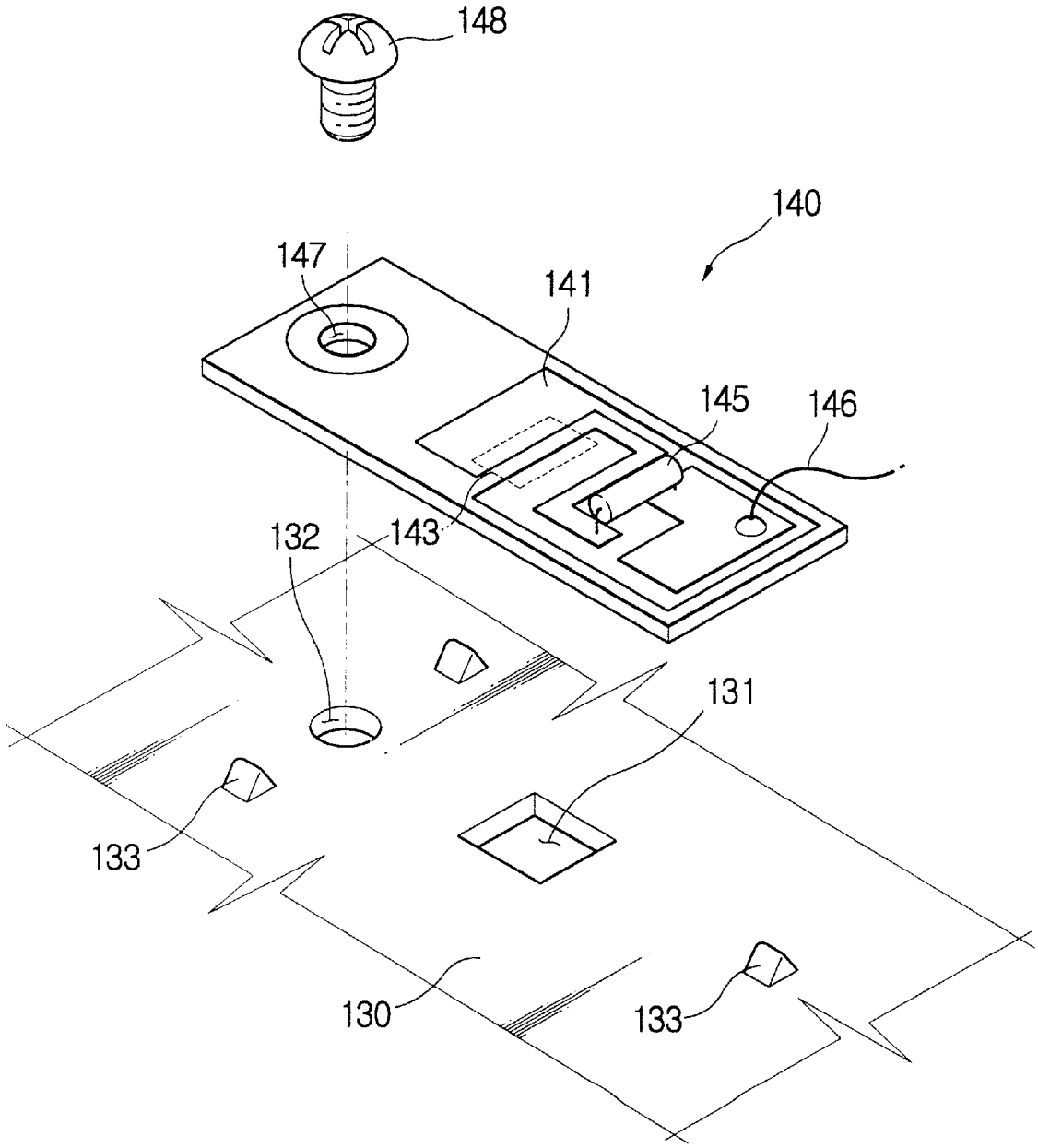
FIG. 4*a* is a perspective view showing another magnetic field detecting device in accordance with a second embodiment of the present invention.

FIG. 4*a* is a perspective view showing another magnetic field detecting device in accordance with a second embodiment of the present invention.

Referring to FIG. 4*a*, in the magnetic field detecting device of the second embodiment, the antenna sensor 143 is formed to divide the detection opening 131 when the magnetic detecting device 140 is mounted on the outer surface of the wave guide 130, similarly to the magnetic field detecting device of the first embodiment. However, the detection holes 144 are not provided beside the antenna sensor 143, and a magnetic field having passed through the detection opening 131 is sufficiently interlinked with the antenna sensor 143.

Figure 4B:
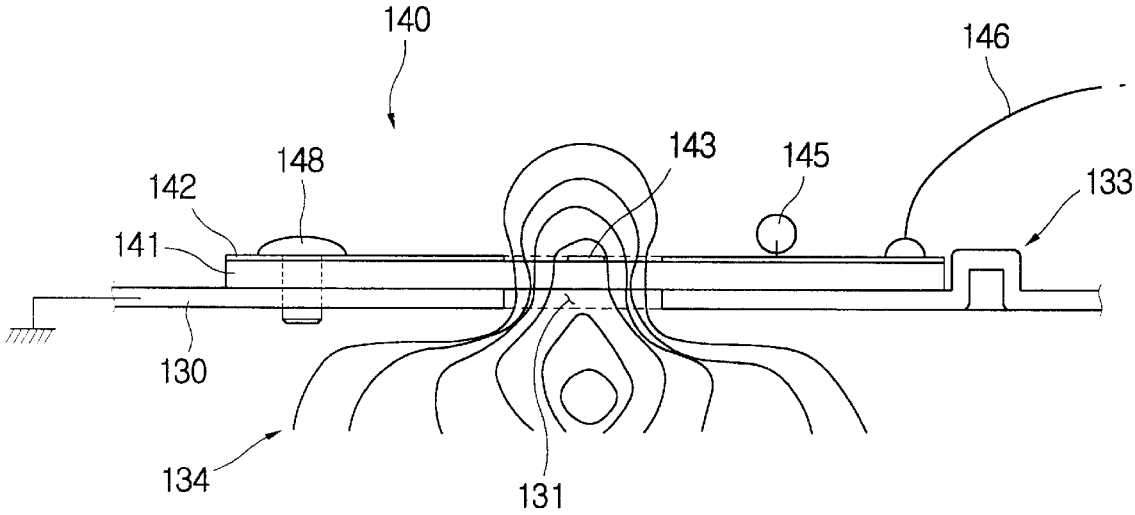
FIG. 4*b* is a diagram showing the detection of a magnetic field by the magnetic field detecting device of the first embodiment.

FIG. 4*b* is a diagram showing the detection of a magnetic field by the magnetic field detecting device of the first embodiment.

Referring to FIG. 4*b*, the magnetic field 134 generated by standing waves formed in the wave guide 130 is discharged from the wave guide 130 through the detection opening 131. In this case, the magnetic field 134 generated by the standing waves forms a closed loop through the non-magnetic printed board 141 positioned beside the antenna sensor 143 of the magnetic field detecting device 140. Accordingly, detection signals, which are alternating signals, are induced to the antenna sensor 143 by the magnetic field 134 generated by the standing waves. The detection signals are rectified by the diode 145 and output through the lead wire 146.

Figure 5:
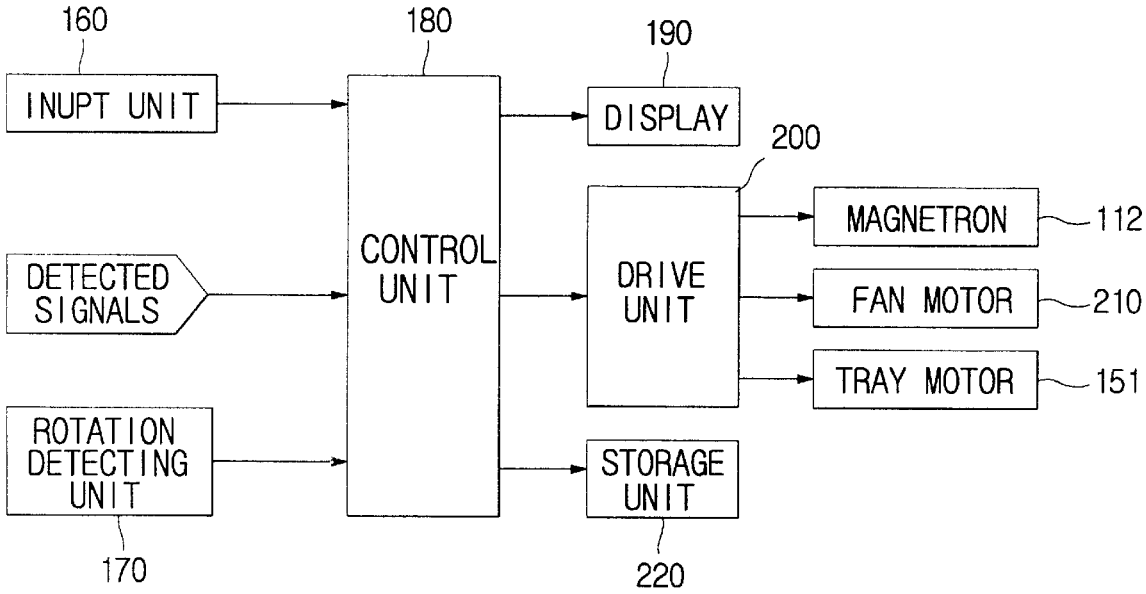
FIG. 5 is a block diagram of the microwave oven with the magnetic field detecting device of the present invention.

FIG. 5 is a block diagram of the microwave oven with the magnetic field detecting device of the present invention.

Referring to FIG. 5, the microwave oven of the present invention includes a control unit 180 for controlling the entire operation of the microwave oven and receiving detection signals, an input unit 160 for receiving information from a user, and a rotation detecting unit 170 connected to the control unit 180 to detect the rotation of the tray 152 rotated by the tray motor 151 during a cooking operation. Additionally, the microwave oven further includes a display 190 for displaying cooking information according to the control of the control unit 180, a magnetron 112, a fan motor 210, a drive unit 200 for driving the tray motor 151, and a storage unit 220 for storing data. The storage unit 220 has preset data for determining the degree of cooking of food according to the variation of standing waves.

The rotation detecting unit 170 detects the rotation of the tray 152. In this embodiment, the rotation of the tray 152 can be detected by detecting the rotation of the tray motor 151.

Figure 6A:
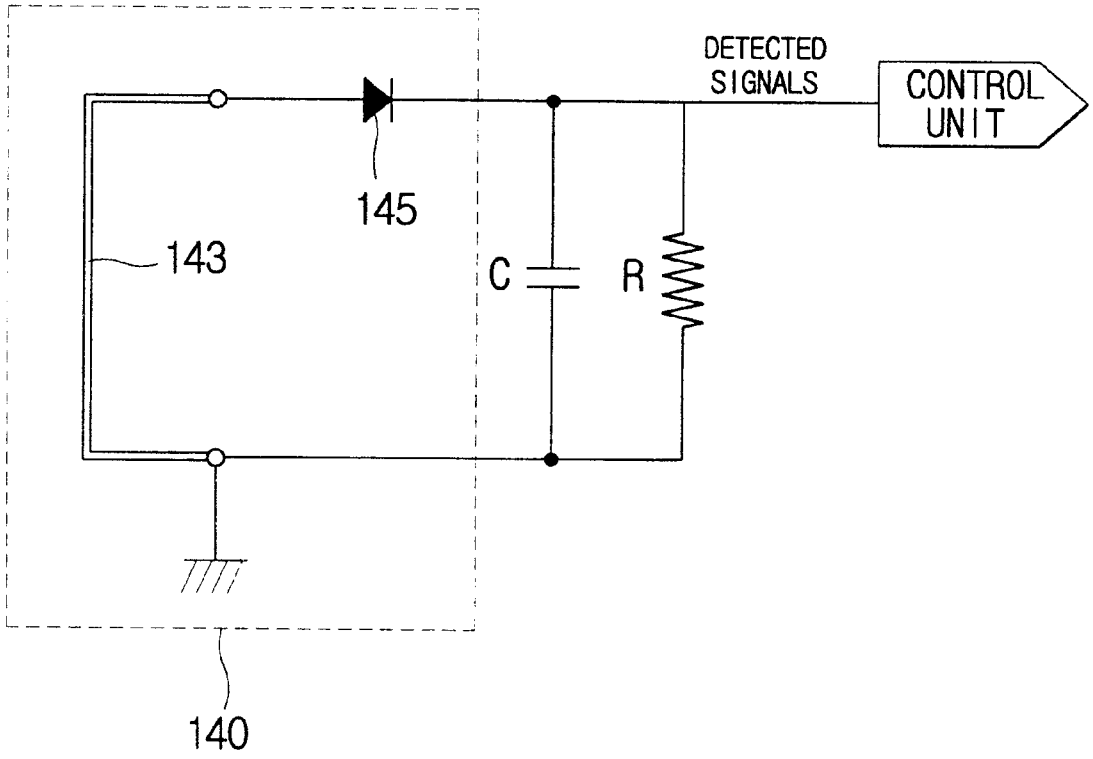
FIG. 6*a* is a first circuit diagram showing the generation of a detection signal by the magnetic field detecting device of the present invention.

FIG. 6*a* is a first circuit diagram showing the generation of a detection signal by the magnetic field detecting device of the present invention. Referring to FIG. 6*a*, a capacitor C and a resistance 8 are connected in parallel to each other between the diode output side and the ground side of the magnetic field detecting device. In the magnetic field detecting devices 140 of the first and second embodiments, output signals are flattened by the capacitor C, and are transmitted to the control unit 180 as detection signals that are direct currents.

Figure 6B:
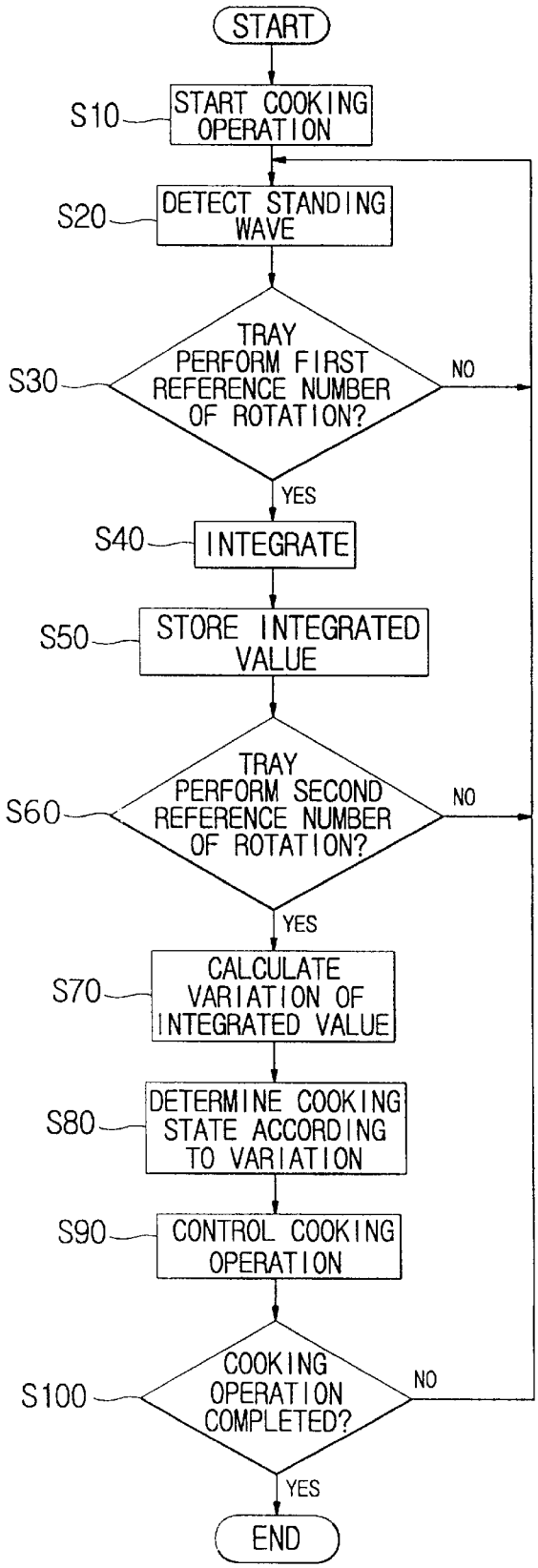
FIG. 6*b* is a flowchart showing the control of the microwave oven of the present invention using the detection signal generated by the electric circuit of FIG. 6*a*.

FIG. 6*b* is a flowchart showing the control of the microwave oven of the present invention using the detection signal generated by the electric circuit of FIG. 6*a*.

When a cooking command is input through the input unit 160, the control unit 180 operates the magnetron 112 by controlling the drive unit 200, thereby initiating a cooking operation (S10). Additionally, the control unit 180 operates the tray motor 151 by controlling the control unit 200. As the tray motor 151 is operated, the tray 152 holding food begins to be rotated.

As described above, when the cooking operation is initiated, the magnetron 112 and the tray motor 151 are operated. As a result, standing waves are formed by waves-moved through the wave guide 130 and waves reflected in the wave guide 130.

A magnetic field generated by the standing waves are discharged through the detection opening 131 formed in one side of the wave guide 130, and are detected by the antenna sensor 143 of the magnetic field detecting device 140 mounted on the outside of the wave guide 130 (S20). Alternating signals induced to the antenna sensor 143 are rectified by the diode 145, and output through the lead wire 146. The signals rectified by the diode 145 of the magnetic field detecting device 140 are flattened by the capacitor C, and input to the control unit 180. The detection signals input to the control unit 180 are stored in the storage unit 220.

The control unit 180 determines whether the tray 152 performs a first preset reference number of rotations, for example, one rotation (S30). When at step S30 the tray 152 performs one rotation, the control unit 180 integrates (S40) detection signals stored in the storage unit 220 while the tray 152 performs one rotation and stores the integrated value in the storage unit 220 (S50).

The control unit 180 determines whether the tray 152 performs a second preset reference number of rotations (S60) greater than the first preset reference number of rotations. When at step S60 the tray 152 performs the second preset reference number of rotations, the control unit 180 calculates the variation of the integration values stored in the storage unit 220 (S70). The control unit 180 determines the cooking state of food by comparing the calculated variation of integration values with preset data (S80). The control unit 180 controls the cooking operation according to the determined cooking state (S90).

The control unit 180 determines whether the cooking operation is completed according to a cooking period of time or cooking state (S100). When at step S100 the cooking period of time lapses or the cooking state is a cooking-completed state, the cooking operation is terminated.

Figure 7A:
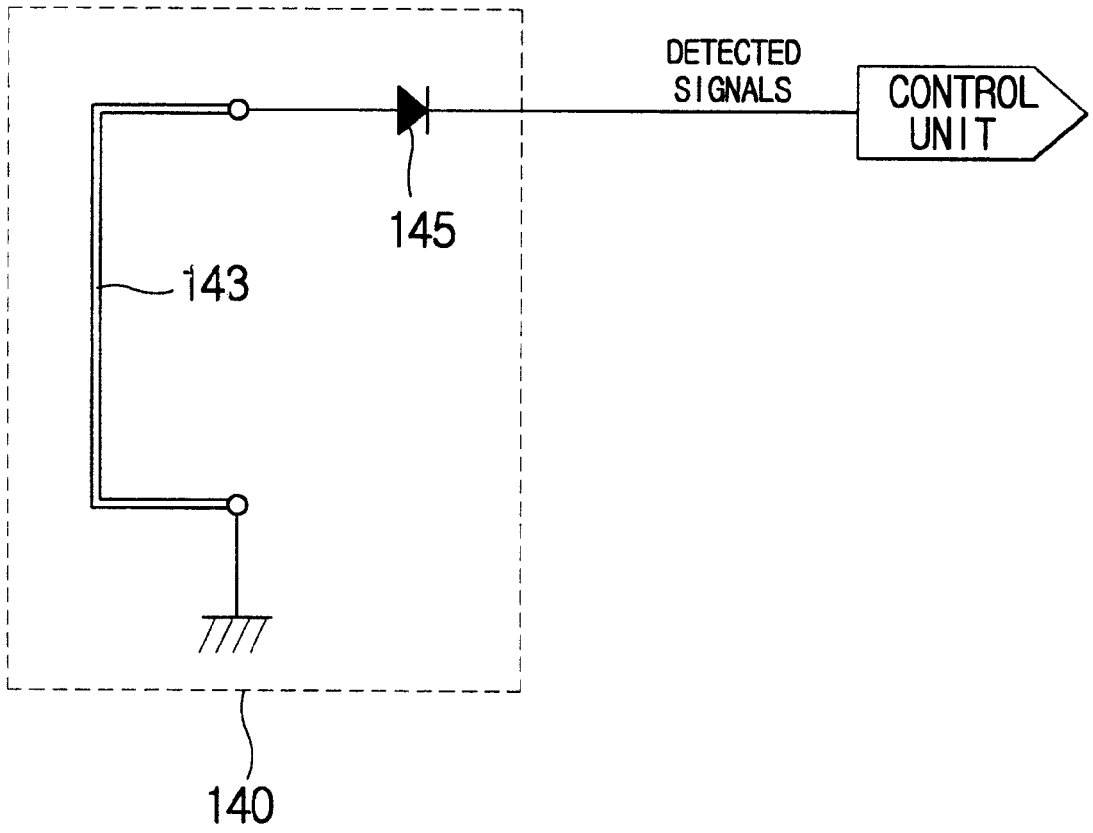
FIG. 7*a* is a second circuit diagram showing the generation of a detection signal by the magnetic field detecting device of the present invention.

FIG. 7*a* is a second circuit diagram showing the generation of a detection signal by the magnetic field detecting device of the present invention.

Referring to FIG. 7*a*, the output signals of the magnetic field detecting devices of the first and second embodiments are detection signals in the form of pulses rectified by the diode 145.

Figure 7B:
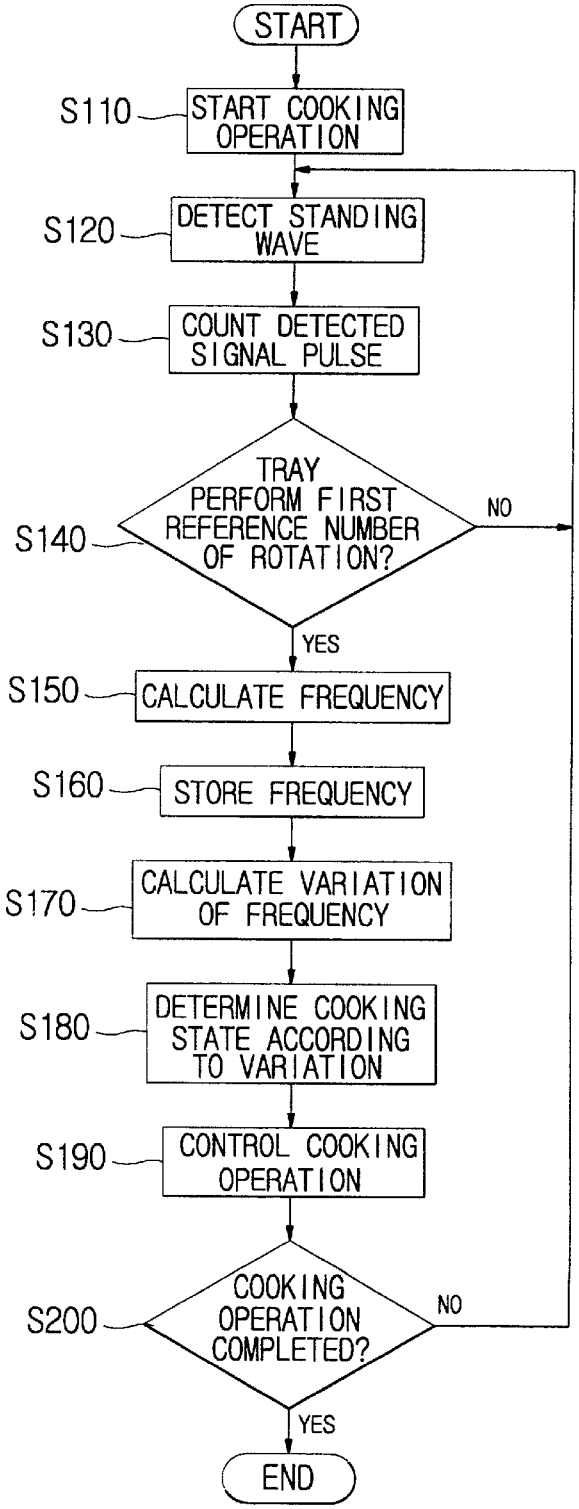
FIG. 7*b* is a flowchart showing the control of the microwave oven of the present invention using the detection signal generated by the electric circuit of FIG. 6*a*.

FIG. 7*b* is a flowchart showing the control of the microwave oven of the present invention using the detection signal generated by the electric circuit of FIG. 6*a*.

When a cooking command is input through the input unit 160, the control unit 180 operates the magnetron 112 by controlling the drive unit 200, thereby initiating a cooking operation (S110). Additionally, the control unit 180 operates the tray motor 151 by controlling the control unit 200. As the tray motor 151 is operated, the tray 152 holding food begins to be rotated.

As described above, when the cooking operation is initiated, the magnetron 112 and the tray motor 151 are operated. As a result, standing waves are formed by waves moved through the wave guide 130 and waves reflected in the wave guide 130.

A magnetic field generated by the standing waves is discharged through the detection opening 131 formed in one side of the wave guide 130, and detected by the antenna sensor 143 of the magnetic field detecting device 140 mounted on the outside of the wave guide 130 (S120). Alternating signals induced to the antenna sensor 143 by the magnetic field generated by the standing waves are rectified by the diode 145, and output through the lead wire 146. In this case, the signals output through the lead wire 146 are detection signals in the form of pulses. The control unit 180 counts the detection signals (S130).

The control unit 180 determines whether the tray 152 performs a first preset reference number of rotations, for example, one rotation (S140). When at step S140 the tray 152 performs one rotation, the control unit 180 calculates frequencies according to the detection signals while the tray 152 performs one rotation and stores these in the storage unit 220 (S160).

The control unit 180 calculates the variation of the frequencies (S170). After step S170, the control unit 180 determines the cooking state of food by comparing the calculated variation of frequencies with preset data stored in the storage unit 220 (S180). The control unit 180 controls the cooking operation according to the determined cooking state (S190).

The control unit 180 determines whether the cooking operation is completed according to a cooking period of time or cooking state (S200). When at step S200 the cooking period of time lapses or the cooking state is a cooking-completed state, the cooking operation is terminated.

As described above, the present invention provides a microwave oven with a magnetic field detecting device, in which an antenna sensor is printed on a board, thereby facilitating the fabrication of the magnetic field detecting device, reducing the fabricating costs of the magnetic field detecting device, and improving the reliability of the magnetic field detecting device by the reduction of the assembly error of the magnetic field detecting device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising:

a magnetron for generating microwaves;

a waveguide for guiding the microwaves to a cooking chamber, said waveguide having a detection opening formed through one sidewall for allowing a magnetic field, generated by standing waves formed in the waveguide, to be discharged from the waveguide; and a printed circuit board disposed on an outer surface of said sidewall, said printed circuit board comprising:

an antenna sensor for sensing said magnetic field discharged from the waveguide; and a pair of openings through said printed circuit board and disposed over said detection opening, said antenna sensor being disposed between said pair of openings.

2. The microwave oven as set forth in claim 1, said printed circuit board further comprising a diode for rectifying an alternating current induced into said antenna sensor by said magnetic waves.

3. The microwave oven as set forth in claim 2, said printed circuit board further comprising a capacitor and a resistor coupled in parallel between an output terminal of said diode and a ground terminal.

4. The microwave oven as set forth in claim 1, further comprising:

a plurality of attachment projections extending above said outer surface of said sidewall between which said printed circuit board is disposed;

a first securing hole disposed through said sidewall;

a second securing hole disposed through said printed circuit board; and a bolt passing through said first and second securing holes for securing said printed circuit board to said sidewall.

5. A microwave oven comprising:

a magnetron for generating microwaves;

a waveguide for guiding the microwaves to a cooking chamber, said waveguide having a detection opening formed through one sidewall for allowing a magnetic field, generated by standing waves formed in the waveguide, to be discharged from the waveguide; and a circuit board disposed on an outer surface of said sidewall, said circuit board comprising:

a magnetic conductive printed circuit forming an antenna sensor for sensing said magnetic field discharged from the waveguide; and a pair of rectangular openings extending through said circuit board and disposed over said detection opening, said antenna sensor being disposed between said pair of rectangular openings.

6. The microwave oven as set forth in claim 5, further comprising:

a plurality of attachment projections extending above said outer surface of said sidewall between which said circuit board is disposed;

a first securing hole disposed through said sidewall;

a second securing hole disposed through said circuit board; and a bolt passing through said first and second securing holes for securing said circuit board to said sidewall.

7. The microwave oven as set forth in claim 5, said circuit board further comprising a diode for rectifying an alternating current induced into said antenna sensor by said magnetic waves.

8. The microwave oven as set forth in claim 7, said circuit board further comprising a capacitor and a resistor coupled in parallel between an output terminal of said diode and a ground terminal.

* * * * *